US005557830A

United States Patent [19]

Davis

[11] Patent Number: 5,557,830

[45] Date of Patent: Sep. 24, 1996

[54] FASTENER

[75] Inventor: William B. Davis, Arlington, Tex.

[73] Assignee: Olympic General Corporation, Reno, Nev.

[21] Appl. No.: 371,412

[22] Filed: Jan. 11, 1995

[51] Int. Cl.[6] ..... A44B 21/00; A44B 1/04

[52] U.S. Cl. ..... 24/459; 24/343; 24/113 MP; 24/462

[58] Field of Search ..... 24/459, 464, 72.1, 24/455, 342.1, 326, 343, 530, 532, 478, 460, 686, 700, 477, 559, 171, 90.1, 92, 104, 113 R, 113 MP, 114.4, 114.12, 618, 614

[56] References Cited

U.S. PATENT DOCUMENTS

| | | | |
|---|---|---|---|
| 397,811 | 2/1889 | Messimer . | |
| 567,195 | 9/1896 | Parramore . | |
| 602,805 | 4/1898 | Humphrey | 24/343 X |
| 678,654 | 7/1901 | Gaillard | 24/520 |
| 696,626 | 4/1902 | Cohen . | |
| 697,808 | 4/1902 | Chauvet . | |
| 898,815 | 9/1908 | Ziegler | 24/700 X |
| 1,056,020 | 3/1913 | Graham . | |
| 1,143,837 | 6/1915 | Kozlowski | 24/700 |
| 1,305,073 | 5/1919 | Decker | 24/326 X |
| 1,368,461 | 2/1921 | Smiley . | |
| 1,399,730 | 12/1921 | Abe | 24/470 |
| 2,154,864 | 4/1939 | Purinton | 24/326 X |
| 2,300,342 | 10/1942 | Cheney | 24/478 |
| 2,435,082 | 1/1948 | Huber | 24/459 |
| 2,447,904 | 8/1948 | Falsey | 24/477 |
| 2,498,154 | 2/1950 | Cantello | 24/455 |
| 2,899,153 | 8/1959 | Parker . | |
| 2,920,368 | 1/1960 | Hacki | 24/493 |
| 3,177,550 | 4/1965 | Borgeson | 24/559 |
| 3,530,550 | 9/1970 | White | 24/464 |
| 3,537,155 | 11/1970 | Burchett | 24/464 |
| 4,175,305 | 11/1979 | Gillis | 24/459 |
| 4,308,647 | 1/1982 | Gillis | 24/460 |
| 4,660,240 | 4/1987 | Hutton et al. | 24/459 X |
| 5,033,170 | 7/1991 | Ewert | 24/459 |
| 5,046,222 | 9/1991 | Byers et al. | 24/459 X |
| 5,117,537 | 6/1992 | Hunter et al. | 24/455 X |

FOREIGN PATENT DOCUMENTS

| | | | |
|---|---|---|---|
| 630571 | 12/1927 | France | 24/478 |
| 1047398 | 12/1953 | France | 24/700 |
| 132500 | 7/1951 | Sweden | 24/459 |
| 189038 | 4/1964 | Sweden | 24/459 |

*Primary Examiner*—Peter M. Cuomo
*Assistant Examiner*—Robert J. Sandy
*Attorney, Agent, or Firm*—Locke Purnell Rain Harrell; Randall C. Brown; James F. Struthers

[57] ABSTRACT

A fastener comprising a retainer and a collar wherein one or more sheets of material may be secured between the retainer and collar, and wherein the fastener may be weighted or attached to a variety of objects.

16 Claims, 1 Drawing Sheet

FASTENER

BACKGROUND OF THE INVENTION

1. Field of the Invention

The present invention relates to a fastener. The fastener has particular utility in securing a sheet of flexible material in a desired position, securing one such sheet to another, or securing a desired object to such a sheet.

2. Description of Related Information

It is frequently desirable to securely hold a sheet of plastic, canvas, waterproof tarpaulin, fabric, or other material in a particular location. For example, fastening means are desirable for securing a tent to its stakes.

It is also desirable on occasion to secure two or more sheets to each other or to secure an object to a sheet, such as a lamp hanging within a tent, or a weight hanging from the side of a sheet. In certain applications, it is also desirable to prevent rotation of a sheet of material relative to a fastener or stationary object since rotation may initiate stretching or tearing of the sheet, and may disturb items covered by the sheet.

In the past, a variety of devices were used for fastening sheets to other objects, including devices that employed collar-retainer systems. In a collar-retainer system, the retainer may be alternately engaged or disengaged within the collar. By placing the sheet between the collar and retainer before engaging the two, the collar-retainer system is secured to the sheet. Two sheets may be attached to one another by placing both within a collar-retainer. To secure the sheet to another object, collar-retainer systems have employed hooks or slots integrally attached to the collar.

In a collar-retainer system, there must be sufficient clearance or flexibility between the retainer and collar to allow one or more sheets to be placed therebetween. However, the retainer and collar must also form a tight enough connection to prevent the retainer and collar from disengaging under stress. Devices employed in the past suffered from collar-retainer combinations that were too tight, resulting in difficulty of use and an increased risk of contact part fatigue, or too loose, resulting in a lack of dependability due to collar-retainer separation under stress.

In addition, fasteners in the past featured circular retainer-collar combinations that allowed relative rotation. Those retainer-collar systems that did not employ circular combinations employed collars having oddly shaped protrusions subject to fatigue failure under repeated stress. Finally, fasteners in the past used hooks or slots that suffered from limited versatility due to their size—and means—specific nature, and due to inaccessible connection points.

A need exists, therefore, for a fastener that provides a tight fit between the retainer and the collar but allows placement of a sheet therebetween, that is quick and easy to engage and disengage, and that is relatively free of easily fatigued protrusions. A need also exists for a fastener that is versatile enough to be securely attached to hooks, ropes, screws, nails, conventional tent stakes, and a variety of other securing means. Finally, a need exists for a fastener that can be secured in a given orientation and that will resist rotation therefrom.

SUMMARY OF THE INVENTION

The apparatus of the present invention overcomes the above-mentioned disadvantages and drawbacks which are characteristic of the related information. In addition, the apparatus of the present invention includes a collar and a retainer that provide an increasingly tightening fit therebetween when a sheet of material is secured to the fastener and under tension.

According to the apparatus of the present invention, the retainer and collar each have an essentially triangular configuration. In a preferred embodiment of the present invention, the collar comprises a triangular frame and the retainer comprises a triangular frame having a central hub. The retainer and collar are equiangular triangles, the collar triangle having a greater height than the retainer triangle. In an alternate preferred embodiment, the hub may further comprise a ballast weight.

In another preferred embodiment, the retainer comprises a groove defined by upper and lower flanges along its outer circumference. The groove is adapted to snugly receive the collar frame. When the retainer is engaged within the collar, two legs of the collar and retainer mate, while a gap is formed between the remaining legs. At the remaining legs, a smooth tongue protrudes inwardly from the collar frame across the gap and into the retainer groove.

The retainer and collar are engaged and disengaged by flexing the collar frame. The collar frame or retainer flanges may be elastically deformed within a range sufficient to allow one of the retainer flanges to be urged around the tongue so that the tongue is received within the groove.

In yet another preferred embodiment of the present invention, the collar frame also includes a frame extension extending from one leg of the frame. The frame extension comprises a substantially triangular portion having a slot for connecting to hooks, rope, stakes, or other means. Preferably, the slot is T-shaped to allow a conventional tent stake to be driven therethrough. In another preferred embodiment, the T-shaped slot has a circular slot superimposed thereon, to allow the fastener to be hooked over a nail or bolt. In this embodiment, the head of the nail or bolt is received through the circular portion of the slot, and, depending on the direction of applied tension, the nail shaft proceeds down the trunk or one of the respective arms of the T-shaped slot.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings.

DESCRIPTION OF THE PREFERRED EMBODIMENTS

Figure 1:
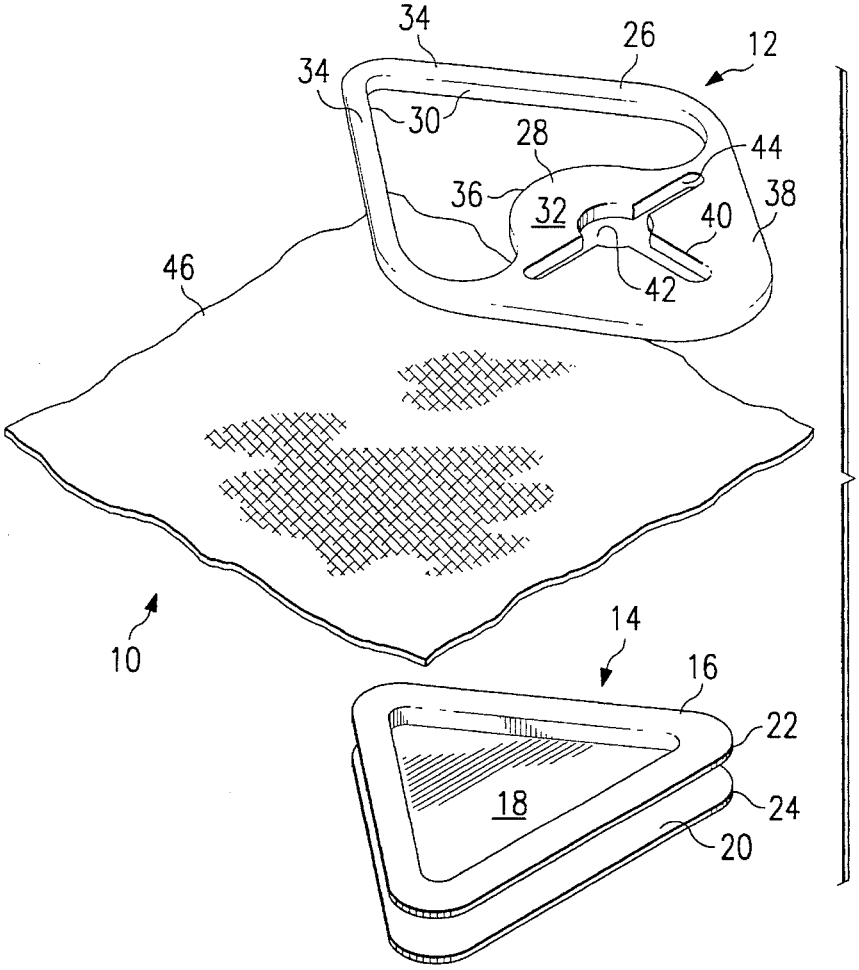
FIG. 1 is a perspective view of a preferred embodiment of the fastener of the present invention in a disengaged condition.
Figure 2:
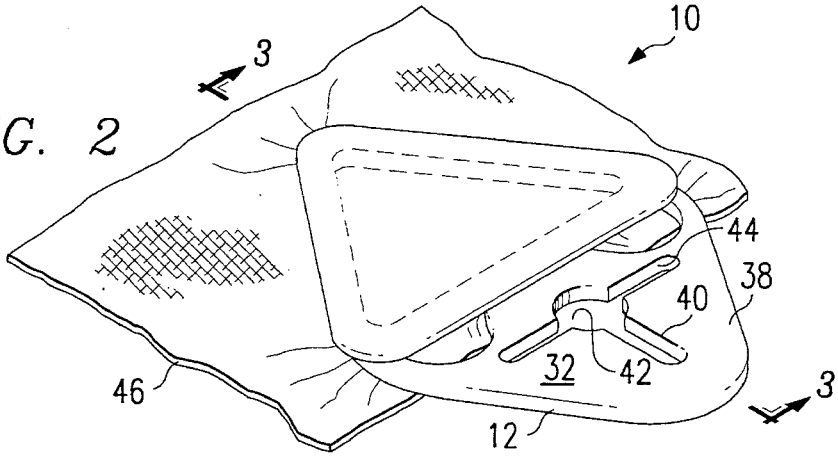
FIG. 2 is a perspective view of the fastener shown in FIG. 1 in an engaged condition.

Referring now to the drawings, and particularly to FIG. 1, a preferred embodiment of the fastener of the present invention is shown and generally designated by the reference numeral 10.

The fastener 10 includes a flexible plastic collar 12 and a plastic retainer 14. The retainer 14 comprises a substantially triangular frame 16 surrounding a hub 18, and having a groove 20 defined by upper and lower flanges 22 and 24 disposed around the outer circumference of the retainer frame 16. In another preferred embodiment, a ballast weight (not shown) may be attached to the hub 18 using conventional means. In still another embodiment, the hub 18 may be deleted from the retainer 14.

Figure 3:
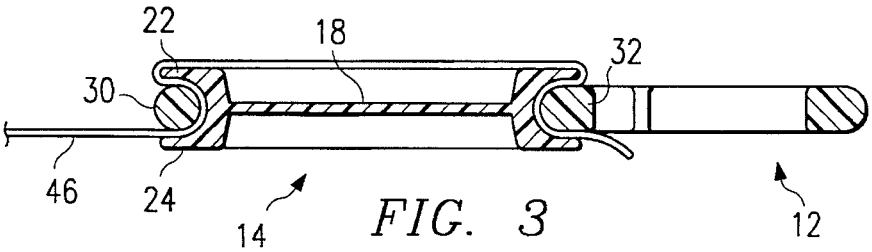
FIG. 3 is a cross-section view of the fastener shown in FIG. 2 taken along line 3—3.

The collar 12 comprises a substantially triangular resilient flexible frame 26, having a primary leg 28 and two secondary legs 30. As shown in FIG. 3, the secondary legs 30 have a cylindrical cross-section. A tongue 32 protrudes inwardly from the primary leg 28. The inner faces 34 of the secondary legs 30, and the tip 36 of the tongue 32 are adapted to be received within the groove 20 of the retainer 14 when the retainer 14 is placed within the collar 12. In a preferred embodiment, the tongue 32 is smoothly contoured.

Those of ordinary skill in the art will recognize that a variety of tongue contours and shapes may be employed according to the present invention. Those of ordinary skill in the art will also recognize that the tongue 32 is not required if the collar and retainer are sufficiently resilient and flexible to allow the retainer to be popped in and out of the collar.

According to the preferred embodiment of the present invention, the collar 14 includes a collar extension 38 that is integrally attached to the primary leg 28 and protrudes outwardly therefrom. The preferred collar extension 38 is substantially triangular, so that the collar 12 has an overall parallelogram or diamond shape. The collar extension 38 comprises a slot 40 having a circular slot portion 42 superimposed on a substantially T-shaped slot portion 44.

Those of ordinary skill in the art will recognize that the shape of the slot 40 may be varied to suit the demands of the application, and that many conventional slot shapes may be employed. Those of ordinary skill will also recognize that the frame extension may extend from any leg, not necessarily the primary leg 28. Finally, those of ordinary skill in the art will recognize that a frame extension is not required where the fastener 10 is used as ballast or to secure two or more sheets to one another.

In operation of the preferred fastener where it is desired to secure a sheet in a desired location, one or more sheets of material 46 are placed over the retainer 14. The collar 12 is elastically flexed about the primary leg 28 to allow retainer 14 and the sheet 46 to be disposed within collar frame 26 such that the secondary legs 30 and the tongue 32 are disposed within the retainer groove 20.

Once the sheet 46 is secured to the fastener 10, the fastener 10 may be secured to a desired object. In the case of a tent stake, the stake is merely driven through the slot 40. In the case of a nail or bolt, a nail or bolt head may be received through the circular slot portion 42 and then urged into one of the legs of the T-shaped slot portion 44. In the case of a rope, a rope may be looped through the circular slot portion 42 and then urged into one of the legs of the T-shaped slot portion 44. Instead of being looped, the rope may also be tied into a knot of greater diameter than the circular slot portion 42 at one end to prevent the rope from slipping through the slot 40. The other end of the rope is then secured as desired.

While preferred embodiments of the invention have been shown and described, it will be understood by persons skilled in the art that various changes and modifications may be made without departing from the spirit and scope of the invention which is defined by the following claims.

What is claimed is:

1. A fastener, comprising:

a) a retainer having a substantially triangular frame and a groove disposed about the outer circumference of said frame; and b) a collar having a substantially triangular frame, said collar frame having first, second and third legs, each said leg having an inner sidewall adapted to be received within said groove of said retainer, wherein said collar frame and said retainer frame are equiangular.

2. The fastener of claim 1 wherein said retainer comprises resilient flexible plastic material.

3. The fastener of claim 1 wherein said collar comprises resilient flexible plastic material.

4. The fastener of claim 1 wherein said retainer and said collar comprise resilient flexible plastic material.

5. The fastener of claim 1 wherein said retainer further comprises a hub.

6. The fastener of claim 5 wherein said hub further comprises a ballast weight.

7. The fastener of claim 1, wherein said first and second legs of said collar frame have a cylindrical cross-section.

8. The fastener of claim 7 further comprising a frame extension protruding outwardly from said third leg of said collar frame, said frame extension comprising a slot.

9. The fastener of claim 8 wherein said slot is substantially T-shaped.

10. The fastener of claim 9 wherein said slot further comprises a circular slot superimposed on said T-shaped slot.

11. The fastener of claim 8 wherein said slot is circular.

12. The fastener of claim 7 wherein said collar frame further comprises an inwardly protruding tongue disposed on said third leg of said collar frame, said tongue being received within said groove when said retainer is disposed within said collar.

13. The fastener of claim 12 further comprising a frame extension protruding outwardly from said third leg of said collar frame, said frame extension comprising a slot.

14. The fastener of claim 13 wherein said slot is substantially T-shaped.

15. The fastener of claim 14 wherein said slot further comprises a circular slot superimposed on said T-shaped slot.

16. The fastener of claim 13 wherein said slot is circular.

* * * * *